US007824211B1

(12) United States Patent
Wu

(10) Patent No.: US 7,824,211 B1
(45) Date of Patent: Nov. 2, 2010

(54) POWER ADAPTER CABLE

(75) Inventor: Jui-Hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 0 days.

(21) Appl. No.: 12/572,270

(22) Filed: Oct. 2, 2009

(51) Int. Cl.
*H01R 11/00* (2006.01)

(52) U.S. Cl. ..... 439/502; 439/655; 439/732

(58) Field of Classification Search ..... 439/374, 439/732, 502, 606, 655, 680; 320/110–114
See application file for complete search history.

(56) References Cited

U.S. PATENT DOCUMENTS 6,036,533 A * 3/2000 Huang ..... 439/502
6,981,662 B2 * 1/2006 Luedicke ..... 239/585.1
7,121,899 B2 * 10/2006 Homann et al. ..... 439/680
7,489,952 B2 * 2/2009 Simoes et al. ..... 455/573
7,621,771 B2 * 11/2009 Petzl et al. ..... 439/358

* cited by examiner

*Primary Examiner*—Thanh-Tam T Le

(57) ABSTRACT

A power adapter cable is adapted to be connected between a charger having mating electrode passages with mating electrode pins therein and a power plug having mating electrode plugs with mating inserting holes. The power adapter cable includes an adapter plug having a base, an adapter socket having an insulating body and a wire connected therebetween. A front surface of the base is protruded forward to form electrode plugs with inserting holes passing therethrough. The electrode plugs of the adapter plug are inserted into the mating electrode passages of the charger with the mating electrode pins being inserted into the inserting holes. A rear surface of the insulating body is recessed inward to form electrode passages with electronic pins therein. The mating electrode plugs of the power plug are inserted into the electrode passages of the adapter socket with the electrode pins being inserted into the mating inserting holes.

10 Claims, 3 Drawing Sheets

(1) (2)

POWER ADAPTER CABLE

BACKGROUND OF THE INVENTION

1. Field of the Invention

The present invention generally relates to an adapter cable, and more particularly to a power adapter cable.

2. The Related Art

A charger and a power plug mated with the charger are adapted for charging an electronic product. The electronic product is directly electrically connected with the charger. The charger is electrically connected with the power plug and the power plug is further electrically connected with an external power supply so as to gain power for the electronic product. However, there are not any other mediums between the charger and the power plug, and the external power supply is usually set on the wall so that the electronic product is apt to fall off from the wall. When the external power supply is set to be close to the floor, the electronic product needs to be set on the floor so that the electronic product is likely to be damaged.

SUMMARY OF THE INVENTION

An object of the present invention is to provide a power adapter cable adapted to be connected between a charger and a power plug. The charger has mating electrode passages with mating electrode pins mounted therein respectively. The power plug has mating electrode plugs with mating inserting holes passing therethrough respectively. The power adapter cable includes a wire, an adapter plug electrically connected with one end of the wire and an adapter socket electrically connected with the other end of the wire. The adapter plug has a base. A portion of a front surface of the base is protruded forward to form electrode plugs with inserting holes axially passing therethrough respectively. The electrode plugs of the adapter plug are inserted into the corresponding mating electrode passages of the charger with the mating electrode pins being inserted into the corresponding inserting holes. The adapter socket has an insulating body. A rear surface of the insulating body is recessed inward to form electrode passages with electronic pins axially disposed therein respectively. The mating electrode plugs of the power plug are inserted into the corresponding electrode passages of the adapter socket with the electrode pins being inserted into the corresponding mating inserting holes so that an electrical connection can be formed between the charger and the power plug through the power adapter cable.

As described above, the power adapter cable is connected between the charger and the power plug so that an electronic product connected with the charger can be placed at a relatively safe place with the charger when in charge and this can prevent the electronic product from being damaged.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
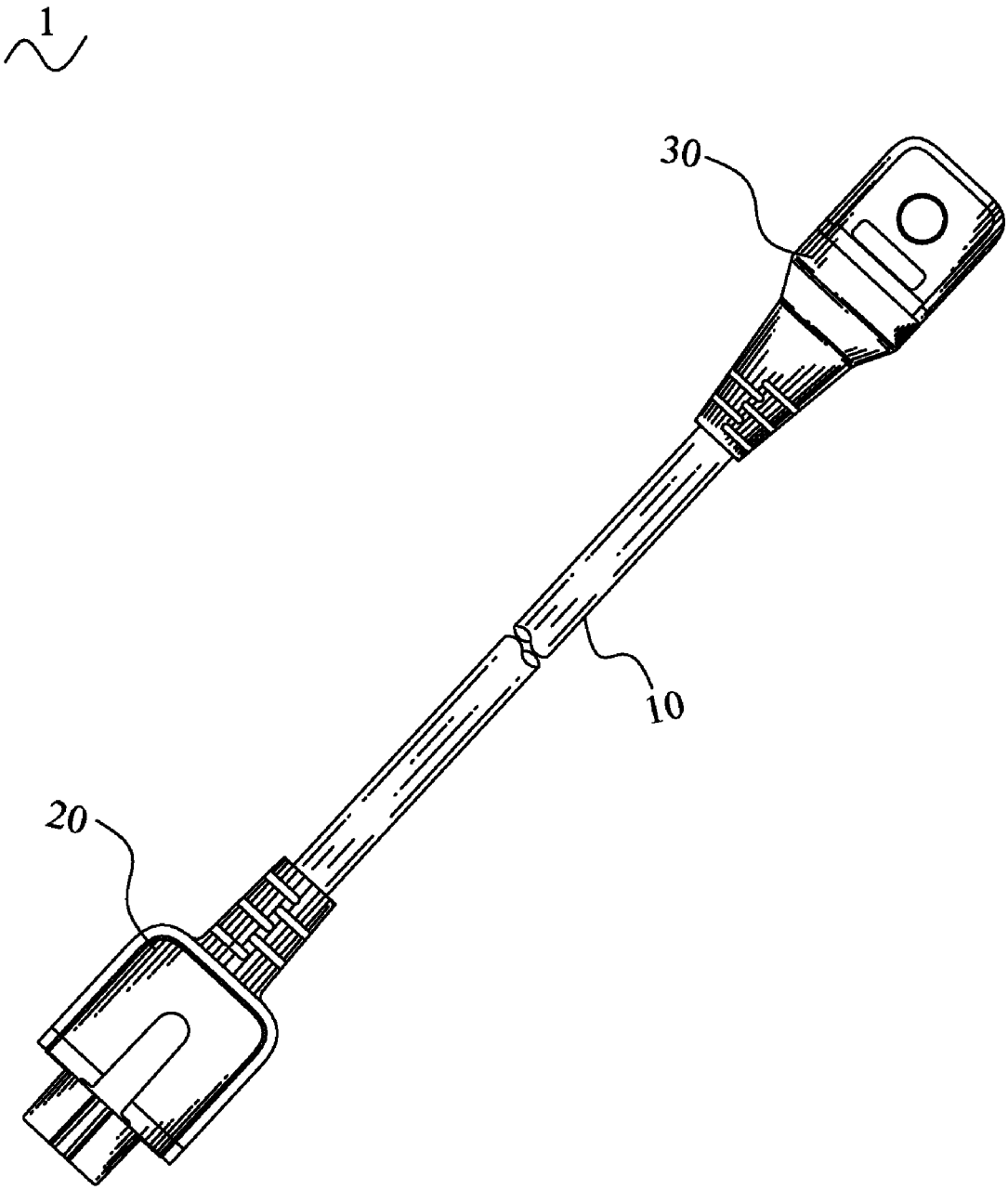
FIG. 1 is a perspective view of a power adapter cable in accordance with the present invention.
Figure 4:
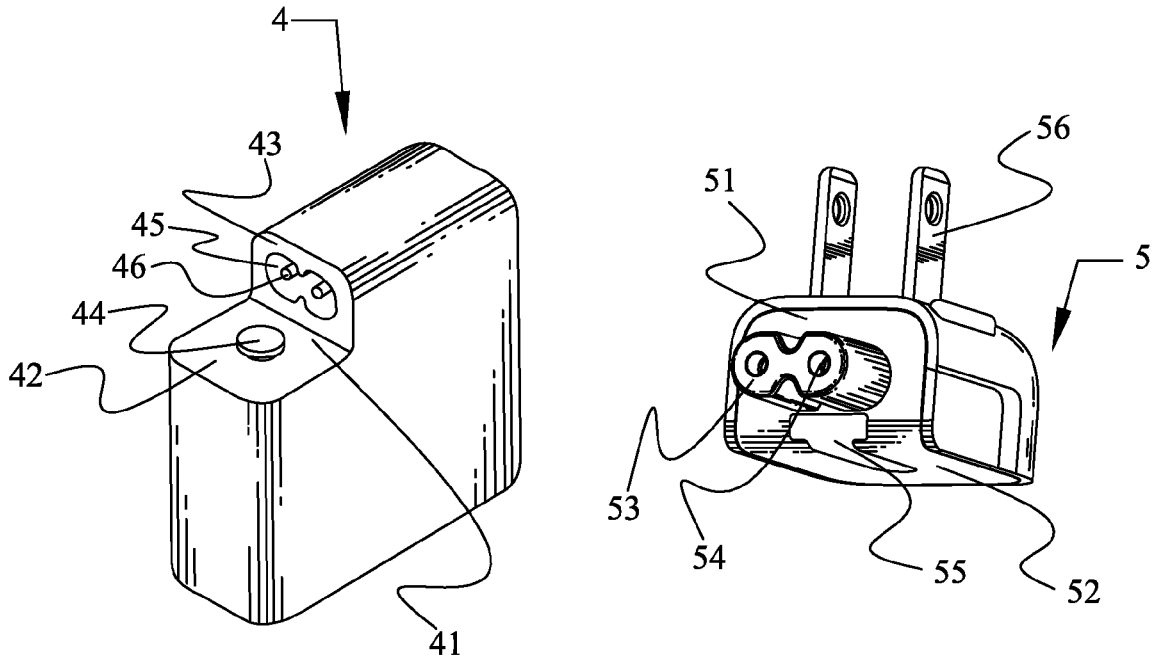
FIG. 4 is a perspective view of a charger which is mated with the adapter plug of FIG. 2 and a power plug which is mated with the adapter socket of FIG. 3.

Referring to FIG. 1 and FIG. 4, a power adapter cable 1 in accordance with the present invention is used for electrically connecting a charger 4 to a power plug 5 so as to charge an electronic product (not shown) connected with the charger 4, wherein the power plug 5 is adapted to connect with an external power supply (not shown) so as to gain power for the electronic product through the power adapter cable 1 and the charger 4. The power adapter cable 1 includes a wire 10, an adapter plug 20 and an adapter socket 30 electrically connected with two opposite ends of the wire 10 respectively.

Figure 2:
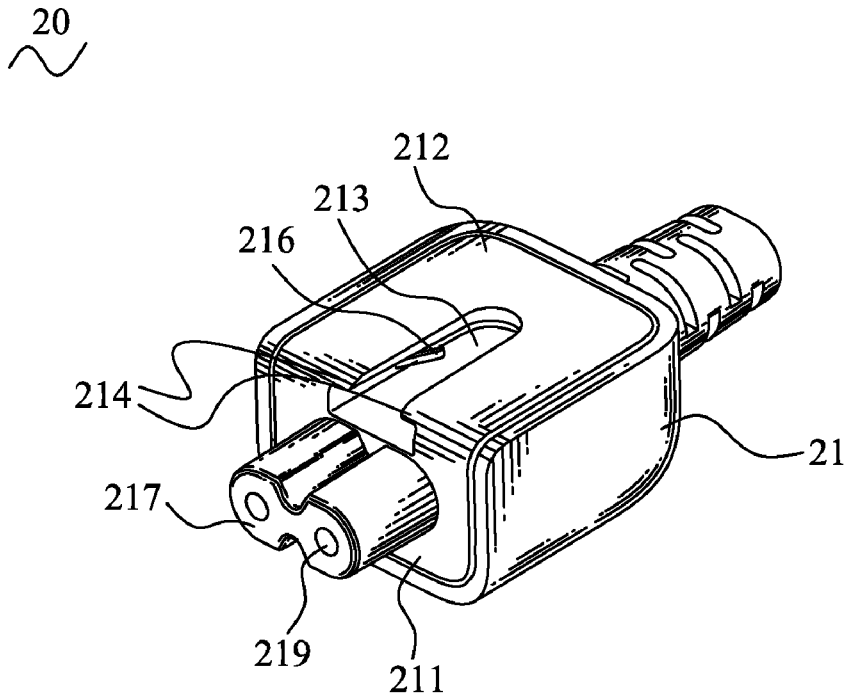
FIG. 2 is a perspective view of an adapter plug of the power adapter cable of FIG. 1.

With reference to FIG. 2, the adapter plug 20 has a base 21 with substantially rectangular shape. A middle of a top surface 212 of the base 21 defines a holding groove 213 extending longitudinally to pass through a front surface 211 of the base 21. An inner peripheral upper edge of the holding groove 213 is protruded into the holding groove 213 to form a substantially U-shaped preventing portion 214. An inside of the holding groove 213 is further provided with a pair of elastic pieces 216 which are face-to-face protruded into the holding groove 213 under the preventing portion 214 and extend rearward with two rear ends thereof gradually inclining towards each other. A middle of the front surface 211 of the base 21 protrudes forward to form a pair of lying-columniform electrode plugs 217 paralleling to each other and aligned in a transverse direction with adjacent parts being fused together. A substantial middle of each of the electrode plugs 217 axially defines an inserting hole 219 passing therethrough. A conductor (not shown) is provided in the inserting hole 219 for being electrically connected with one end of the wire 10 through the base 21.

Figure 3:
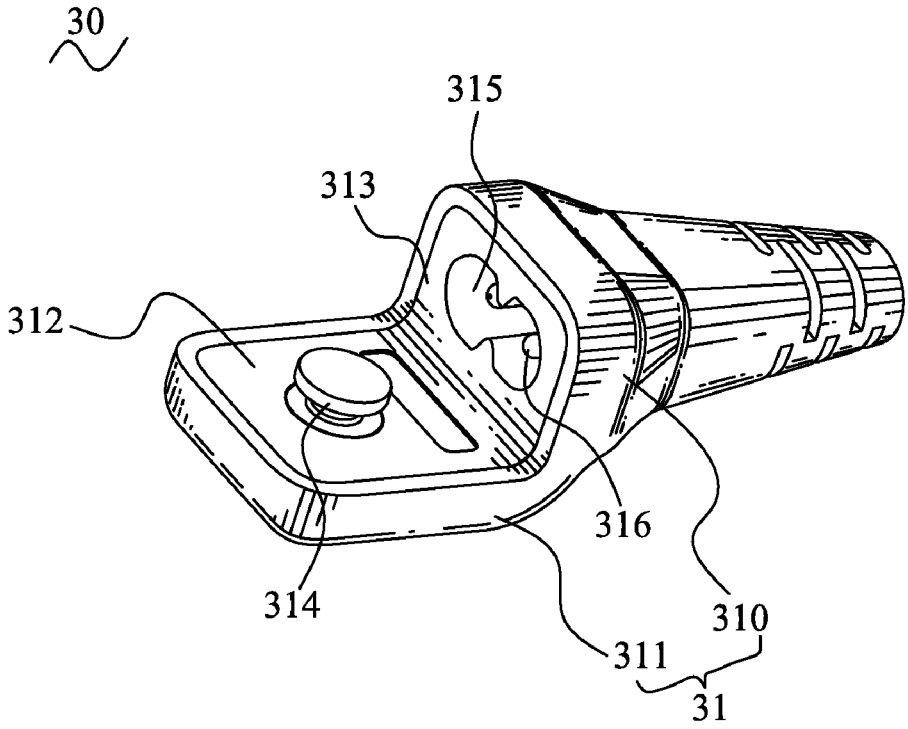
FIG. 3 is a perspective view of an adapter socket of the power adapter cable of FIG. 1.

Referring to FIG. 3, the adapter socket 30 has a substantially L-shaped insulating body 31 from a lateral view with a first body 310 and a second body 311. A middle of a top surface 312 of the second body 311 is protruded upward to form a mushroom holding portion 314. A middle of a rear surface 313 of the first body 310 is recessed inward to form a pair of substantial columniform electrode passages 315 paralleling to each other to be aligned in a transverse direction and communicating with each other. A pair of electrode pins 316 is axially provided in the corresponding electrode passages 315 respectively and electrically connected with the other end of the wire 10 through the first body 310.

Referring to FIG. 4, the charger 4 is of substantial rectangular shape. One corner of the charger 4 is cut off to form a rectangular notch 41 with a first inner surface 42 and a second inner surface 43 perpendicularly connected with each other. A middle of the first inner surface 42 protrudes perpendicularly to form a mushroom fixing portion 44. A middle of the second inner surface 43 is recessed inward to form a pair of mating electrode passages 45 communicating with each other and corresponding to the electrode plugs 217 of the adapter plug 20 with a pair of mating electrode pins 46 axially mounted therein, respectively. The charger 4 is further provided with a port (not shown) for connecting with the electronic product. The power plug 5 is of substantial rectangular shape and has a first outer surface 51 and a second outer surface 52 perpendicularly connected with each other. A middle of the first outer surface 51 protrudes perpendicularly to form a pair of mating electrode plugs 53 fused together and corresponding to the electrode passages 315 of the adapter socket 30. Each of the mating electrode plugs 53 axially defines a mating inserting hole 54 passing therethrough. A middle of the second outer surface 52 defines a fixing groove 55 passing through the first outer surface 51. The power plug 5 is further provided with a pair of inserting portions 56 for electrically connecting with the external power supply.

With reference to FIGS. 1-4 again, when the power adapter cable 1 is in use, the adapter plug 20 is mated with the charger 4 and the adapter socket 30 is mated with the power plug 5 to form an electrical connection between the charger 4 and the power plug 5. When the adapter plug 20 is inserted into the charger 4, the fixing portion 44 of the charger 4 moves along the holding groove 213 of the adapter plug 20 with the peripheral edge thereof being restrained under the preventing portion 214 until the fixing portion 44 is buckled with the elastic pieces 216. The electrode plugs 217 of the adapter plug 20 are inserted into the corresponding mating electrode passages 45 of the charger 4 with the mating electrode pins 46 being inserted into the corresponding inserting holes 219 to electrically contact the respective conductors. When the power plug 5 is inserted into the adapter socket 30, the holding portion 314 moves along the fixing groove 55 till the mating electrode plugs 53 are completely inserted into the corresponding electrode passages 315 with the electrode pins 316 being completely inserted into the corresponding mating inserting holes 54. At this time, the holding portion 314 is secured in the fixing groove 55. The port of the charger 4 is electrically connected with the electronic product and the inserting portions 56 of the power plug 5 are inserted into the external power supply so as to gain power for charging the electronic product through the power adapter cable 1.

As describe above, the power adapter cable 1 is connected between the charger 4 electrically connected with the electronic product and the power plug 5 inserted into the external power supply so that the electronic product can be placed at a relatively safe place with the charger 4 when in charge and this can prevent the electronic product from being damaged.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A power adapter cable adapted to be connected between a charger which has mating electrode passages with mating electrode pins mounted therein respectively, and a power plug which has mating electrode plugs with mating inserting holes passing therethrough respectively, comprising:

a wire;

an adapter plug electrically connected with one end of the wire and having a base, a portion of a front surface of the base being protruded forward to form electrode plugs with inserting holes axially passing therethrough respectively, the electrode plugs of the adapter plug being inserted into the corresponding mating electrode passages of the charger with the mating electrode pins being inserted into the corresponding inserting holes; and an adapter socket electrically connected with the other end of the wire and having an insulating body, a rear surface of the insulating body being recessed inward to form electrode passages with electronic pins axially disposed therein respectively, the mating electrode plugs of the power plug being inserted into the corresponding electrode passages of the adapter socket with the electrode pins being inserted into the corresponding mating inserting holes so that an electrical connection can be formed between the charger and the power plug through the power adapter cable.

2. The power adapter cable as claimed in claim 1, wherein the electrode passages of the adapter socket have two and each is of lying-columniform shape, the electrode passages are further aligned in a transverse direction with adjacent parts communicating with each other.

3. The power adapter cable as claimed in claim 1, wherein the insulating body of the adapter socket is substantially L-shaped from a lateral view with a first body and a second body, the electrode passages are formed in the first body and the electrode pins are electrically connected with the other end of the wire through the first body.

4. The power adapter cable as claimed in claim 3, wherein a portion of a top surface of the second body protrudes upward to form a holding portion behind the first body.

5. The power adapter cable as claimed in claim 4, wherein the holding portion is of mushroom shape.

6. The power adapter cable as claimed in claim 1, wherein the electrode plugs of the adapter plug have two and each is of lying-columniform shape, the electrode plugs are further aligned in a transverse direction with adjacent part fused together.

7. The power adapter cable as claimed in claim 1, wherein a top surface of the base of the adapter plug defines a holding groove passing through the front surface of the base.

8. The power adapter cable as claimed in claim 7, wherein an inner peripheral upper edge of the holding groove is protruded into the holding groove to form a preventing portion.

9. The power adapter cable as claimed in claim 8, wherein the preventing portion is of substantially U-shaped.

10. The power adapter cable as claimed in claim 7, wherein an inside of the holding groove is provided with a pair of elastic pieces which are face-to-face protruded into the holding groove and extend rearward with two rear ends thereof gradually inclining towards each other for buckling the fixing portion.

* * * * *